United States Patent [19]

Young

[11] Patent Number: 4,696,143

[45] Date of Patent: Sep. 29, 1987

[54] CONTAINER CAPPING APPARATUS

[75] Inventor: William P. Young, Southfield, Mich.

[73] Assignee: William P. Young Co., Farmington, Mich.

[21] Appl. No.: 860,084

[22] Filed: May 6, 1986

[51] Int. Cl.[4] ..... B67B 5/00; B67B 3/22; B65B 7/28

[52] U.S. Cl. ..... 53/289; 53/307; 53/367

[58] Field of Search ..... 53/307, 290, 309, 313, 53/141, 289

[56] References Cited

U.S. PATENT DOCUMENTS

| | | | |
|---|---|---|---|
| 1,040,615 | 10/1912 | Brown | 53/307 X |
| 3,392,505 | 7/1968 | Luther | 53/307 |
| 3,422,597 | 1/1969 | Beer | 53/307 X |
| 3,628,307 | 12/1971 | Croasdale et al. | 53/307 X |
| 3,712,023 | 1/1973 | Bryan, Jr. et al. | 53/307 |
| 3,977,161 | 8/1976 | Faber et al. | 53/313 |
| 4,065,909 | 1/1978 | Mueller | 53/307 X |
| 4,548,668 | 10/1985 | Roth et al. | 53/309 X |

*Primary Examiner*—Horace M. Culver
*Attorney, Agent, or Firm*—Brooks & Kushman

[57] ABSTRACT

A capping machine comprises a rotating carriage positioned above a conveyor delivering open neck containers to a work station position, the carriage including circumferentially positioned sockets that receive snap-lock caps in a fixed orientation from a second conveyor. The carriage rotates about an axis transverse to the direction of conveyance of the first conveyor so that the proximate carriage position closest to the first conveyor has a velocity in the same direction as the direction of conveyance of the container. As the tangential position of the cap on the carriage changes as the cap approaches the proximate carriage position, the cap is progressively engaged against the open neck of the container. At the proximate carriage position, the cap is positioned for sealing engagement with the neck of the container. In the preferred embodiment, the first conveyor is a linear conveyor, and as the leading edge of the cap engages the neck of the container, the velocity component of the cap in the direction of conveyance of the first conveyor exceeds the velocity of the conveyor, whereby the speed of the container through the work station is controlled wholly by the speed of the carriage to assure proper engagement of the cap with the container. The second conveyor means also includes means for feeding the caps to the carriage in a predetermined alignment, and the carriage includes cap receiving heads adapted to maintain the alignment of the caps as they are displaced about the axis of the carriage.

20 Claims, 8 Drawing Figures

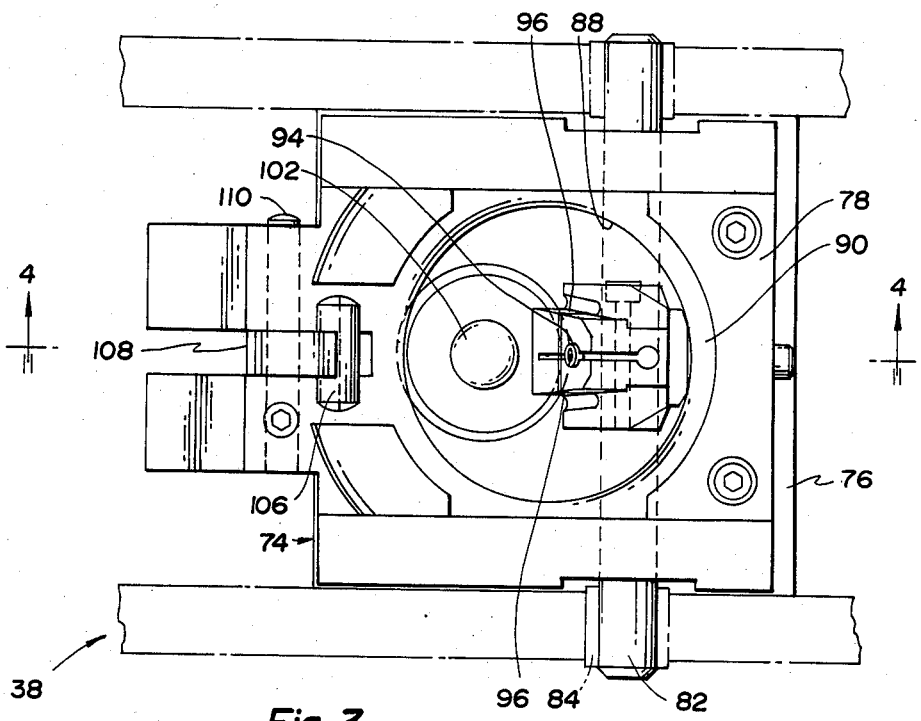
Fig. 3
Fig. 4
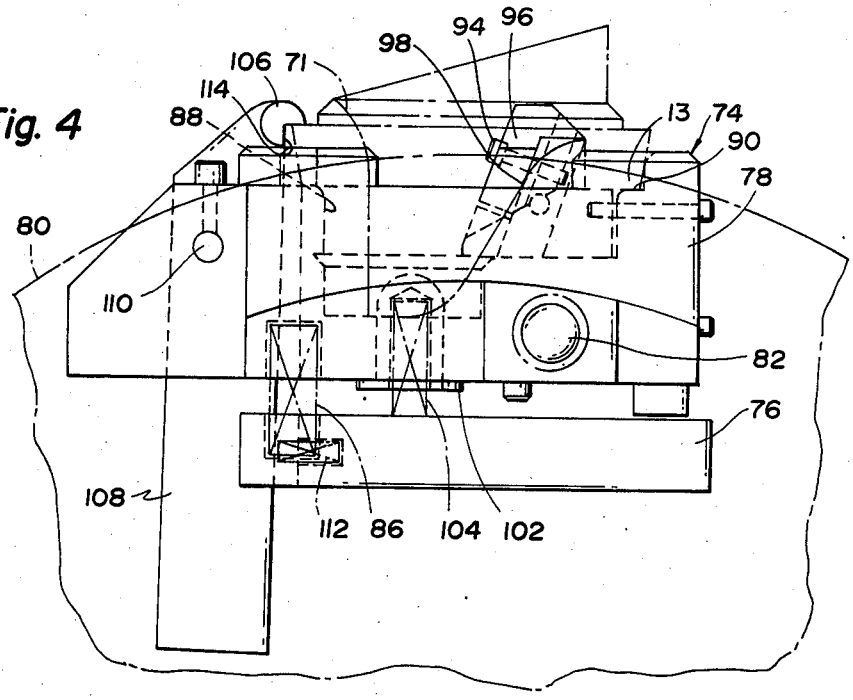

CONTAINER CAPPING APPARATUS

BACKGROUND OF THE INVENTION

I. Field of the Present Invention

The present invention relates generally to apparatus for automaticaly installing caps on necked containers, and more particularly to apparatus for installing particularly configured caps adapted to snap-lock with the neck of the container.

II. Description of the Prior Art

It has been previously been known to automate the installation of caps on necked containers for simple cap structures. For example, an internally threaded cap can be applied to an externally threaded neck by holding the cap in the chuck or the like and then rotating the chuck as it descends in registration with the container neck. Typically, the containers are moved along the conveyor line, and the chuck must therefore be linearly displaced at the same speed as the container while the cap remains in the chuck and in engagement with the container neck. While such devices are advantageous for use in packaging containers of the simple cap structure, the previously known apparatus are not well adapted for use in installing specially configured caps.

A particularly advantageous form of cap which has become available includes a pour spout for controlling the flow of contents from the container as the container is tilted. One particular type of pour spout cap includes a raised spout extending upwardly beyond a rim and supported by an inclined base disposed below the rim. The base has an opening at its lowermost end communicating with an elongated slot in the pour spout. The rim includes a depending lip having means for engaging a peripheral projection on the neck of the container so that the cap can be snap-locked in position on the neck. The inner peripheral wall of the rim is threaded to receive a closure cap which completely covers the open spout, and thus the open neck of the container. When the closure cap is removed, the closure cap is designed to measure a predetermined amount of the contents of the container being poured into the closure cap through the spout. A particular advantage of such packaging enclosures is that any residue contained within the closure cap is returned to the container when the closure cap is remounted to the rim of the pour cap since the residue drains along the inclined base of the pour cap into the container. Since the pour cap has a spout extending upwardly above the rim, and a base inclined downwardly from the rim, the previously known capping apparatus are not well adapted for installing such caps.

Moreover, when the peripheral projection on the neck of the container is continuous around the entire neck, a substantial amount of force would be necessary to concentrically depress the cap upon the neck of the container. Moreover, displacement of the means for depressing the cap along a moving conveyor line must be timed accurately to correspond with the movement of the container along the line. The application of a depressive force when the cap is misaligned with respect to the neck, or application of an excessive force, can cause damage to the cap or the container neck and prevent tight sealing engagement between the cap and the container.

SUMMARY OF THE PRESENT INVENTION

The present invention overcomes the above-mentioned disadvantages by providing a capping apparatus in which the caps are circumferentially arranged on a carriage rotating above a main conveyor which passes containers through a work station position. The carriage rotates about an axis perpendicular to the direction of conveyance of the main conveyor and perpendicular to the axis of the neck of the container as the container is supported by the conveyor at the work station position. As the carriage rotates to displace a cap toward the proximate carriage position closest to the conveyor at the work station, a container is positioned by the main conveyor for receipt of the cap upon the neck of the container. The tangential position of the cap on the carriage at a first predetermined position along the direction of conveyance causes a leading edge of the cap to become engaged with the neck of the container. As the leading edge of the cap reaches the proximate carriage position, the leading edge of the rim of the cap is seated upon the neck, and further movement of the cap through the proximate carriage position progressively engages the cap on the neck to its fully seated position. A synchronizing means times the arrival of a cap at the work station simultaneously with the arrival of a container at the work station.

In the preferred embodiment, the main conveyor linearly displaces the containers through the work station position. Moreover, as the carriage rotates, the velocity of the cap in the direction of conveyance of the main conveyor progressively increases as the cap approaches the proximate carriage position. Thus, the rotational speed of the carriage is selected so that the velocity of the cap in the direction of conveyance exceeds the speed of the first conveyor, whereby the engagement of the leading edge of the cap with the container neck causes displacement of the container along the main conveyor. Consequently, the carriage controls the speed of the container through the work station to assure proper alignment between the cap and the container neck.

The carriage of the preferred embodiment includes means for receiving the cap in the form of at least one head defining a socket adapted to receive the pour spout section of a pouring cap. In addition, the head includes means for maintaining the alignment of the cap within the socket. Such means is in the form of a shoulder adapted to engage the peripheral edges of a slotted opening in the pour spout, and includes means for adjusting the width of the shoulder. A means for retaining the cap within the socket as the carriage rotates about its axis comprises a resiliently biased plunger adapted to be received within the open end of the pour spout. The head also includes means for deflecting the trailing edge of the container neck to ease engagement of the trailing edge of the cap with the neck of the container. Preferably, the means for deflecting comprises a resiliently biased lever mounted adjacent to trailing edge of the socket.

In the preferred embodiment, a second conveyor delivers the caps to the carriage in a fixed orientation and includes means for individually feeding the caps into the sockets in the carriage. The feeding means comprises a plunger aligned in registration with a cap retaining station adjacent the end of the second conveyor at a distal carriage position opposite to the proximate carriage position. As a plunger actuating mechanism reciprocates the plunger, a setter retracts the penultimate cap away from the endmost cap at the retaining station. In addition the setter assures proper orientation of the cap before it reaches the receiving station for insertion into the socket. The actuating mechanism for the plunger is also timed to coincide with the arrival of a cap at the end station of the second conveyor and the arrival of a carriage socket at the receiving station. Moreover, a timing means in the plunger actuating mechanism assures that the setter retracts the penultimate cap prior to actuation of the plunger.

Thus, the present invention provides a novel capping apparatus in which a rotating carriage tangentially aligns a cap for progressive engagement with the open neck of a container. Moreover, the apparatus is particularly well adapted for use in installing particularly configured caps having pour spouts extending above a cap rim and an inclined base extending below the cap rim, and assures that such caps are in proper alignment engaged with the open neck of a container. Furthermore, the capping apparatus eliminates the risk of damaging the cap or the container neck during installation of a snap lock cap on the container neck. These and other advantages will become apparent as the invention is discussed in greater detail in the following detailed description.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which:

FIG. 3 is an enlarged plan view of a portion of the rotating cap carriage shown in FIGS. 1 and 2;

FIG. 4 is a sectional view taken substantially along the line 4—4 in FIG. 3;

DETAILED DESCRIPTION OF A PREFERRED EMBODIMENT

Figure 1:
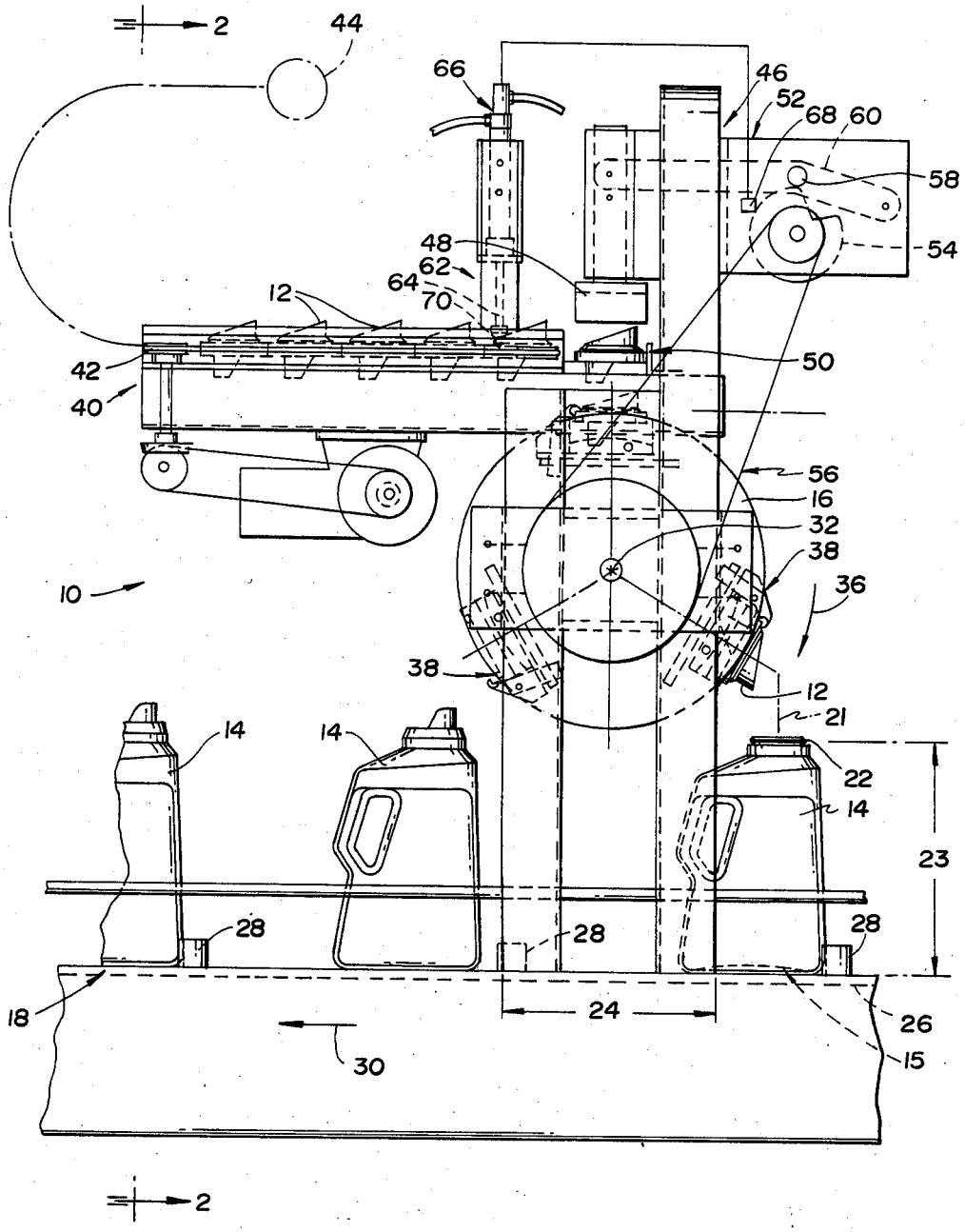
FIG. 1 is a side plan view of a capping apparatus constructed in accordance with the present invention.

Referring first to FIG. 1, a capping apparatus 10 for installing caps 12 on an open necked container 14 comprises a rotatable carriage 16 fixedly positioned above a first conveyor 18. Each cap 12 has a rim 20 with a depending lip having means for lockingly engaging an annular projection on the open neck 22 of the container 14. The pour spout extends upwardly above the rim 20 from an inclined base extending below the rim 20. The inner peripheral wall of the rim surrounding the pour spout is threaded to receive a correspondingly threaded closure cap (not shown). Although the apparatus is particularly well adapted for installation of the particularly configured cap 12 described above, it will be understood that the apparatus can also be used to apply other known caps adapted to lockingly engage an open neck of a container.

The containers 14 in the preferred embodiment have flat bottoms 15, and circular necks 22, whereby a linear conveyor track 26 of the conveyor 18 in the preferred embodiment supports the containers 14 in an upright position. However, the apparatus of the present invention is not limited to such cap and neck configurations, for example, it will be understood that correspondingly configured caps and necks of elliptical or rectangular shape can be installed, whereby the axis 21 can be defined as the central line extending perpendicular to a transverse cross sectional plane through the opening in the neck 22. Moreover, the central axis of the neck can be angled with respect to the base of the container so long as the conveyor 18 or work station frame 25 stably supports the container at the work station position 24 as the cap 12 is installed on the neck 22.

In addition, although the bottoms 15 of the containers 14 are referred to as flat 15, it is to be understood that the term refers only to the fact the container can be stably supported upon a flat surface, and it is not to be understood as a limitation of the type of container for which the capping apparatus of the present invention can be used. Moreover, the limitation includes containers which have configured bottoms such as the concave central portion 17 shown in hidden line in FIG. 1, but which can be stably supported on a flat surface.

The carriage 16 is mounted at a work station position 24 generally defined by a frame 25 along the route of the conveyor 18. The track 26 of the conveyor 18 includes a plurality of spaced apart projections 28 adapted to engage the containers 14 for controlled displacement in the direction of conveyance as shown by the arrow 30 in FIG. 1. The carriage 16 is rotatably mounted to the frame 25 at the work station position 24. The axis of rotation 32 of the carriage 16 is spaced apart from the track 26, perpendicular to the direction of the conveyance 30 and perpendicular to the central axis 21 of the neck 22 of the container 14.

Figure 2:
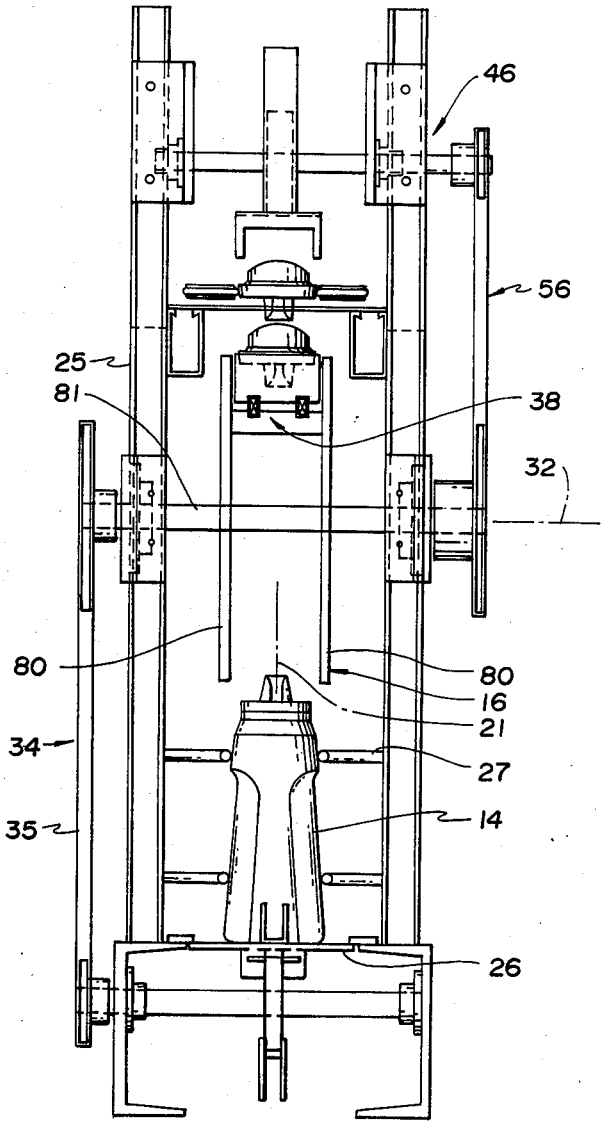
FIG. 2 is a end view of the apparatus taken substantially along the line 2—2 in FIG. 1.

As indicated generally at 34 in FIG. 2, means for rotatably driving the carriage 16 rotatably drives the carriage in the direction of arrow 36 shown in FIG. 1. The carriage 16 includes at least one, and preferably a plurality of, cap receiving means 38 at circumferential positions of the carriage 16, and the axis of rotation of the carriage is positioned so that the proximate position of the carriage 16 closest to the track 26 positions a cap 12 in its locking engagement position with the neck 22 of a container 14 supported on the track 26. As shown in FIG. 2, the carriage 16 is constructed of two side plates 80 adapted to support three cap receiving means 38 therebetween and fixed for rotation with a shaft 81 rotatably mounted to the frame 25 by appropriate bearings. Guide bars 27 are supported by the frame 25 to align the containers 14 beneath the carriage 16. Preferably, the means 34 for rotatably driving the carriage synchronizes rotation of the carriage with the speed of the conveyor track 26 as indicated diagrammatically by the coupling belt 35.

Still referring to FIGS. 1 and 2, the capping apparatus 10 also includes a second conveyor 40 for delivering caps to the carriage 16. In the preferred embodiment, the conveyor 40 includes a conveyor track 42 which transfers a row of caps 12 from an alignment mechanism indicated diagrammatically at 44. The alignment mechanism assures that the caps 12 are aligned with the pour spout positioned for insertion within a receiving means 38 on the carriage 16. The alignment mechanism 44 can also include heating means for softening a pliable seal member inserted in the rim of the cap for tightly sealing the cap 12 to the container neck 22 when the cap 12 is installed. The apparatus of the preferred embodiment also includes a feeder 46 for individually inserting the aligned caps 12 in the receiving means 38 of the carriage 16.

The feeder 46 comprises a plunger 48 disposed above a retaining station 50 adjacent the end of the conveyor track 42. The plunger 48 is reciprocated by an actuating means 52 to displace the endmost cap 12 from the retaining station 50 into the receiving means 38 on the carriage 16. The actuating means 52 comprises a rotatable cam 54 whose rotation is timed in coordination with rotation of the carriage 16, for example, by a chain and sprocket connection 56 as shown in FIGS. 1 and 2, so that depression of the plunger occurs when a receiving means 38 of the carriage 16 is positioned beneath the retaining station 50 for receipt of the cap 12. A cam follower 58 on the pivoted lever arm 60 follows the peripheral surface of the cam 54 to control the reciprocating action of the plunger 48.

The feeder 46 also includes a setter 62 positioned upstream of the retaining station 50. The setter includes a plunger 64 which is aligned for extension into the opening in the bottom of a cap 12 on the conveyor track 42 to restrict displacement towards the retaining station 50. A setter actuating means 66, preferably in the form of a pneumatic cylinder, is synchronized by appropriate means such as the photo-electric cell switch 68, which monitors displacement of the detent in the cam 54, and causes extension of the plunger 64 a short time before actuation of the plunger 48. Thus, the setter prevents displacement of the penultimate cap toward the receiving station 50 which would interfere with insertion of the end cap 12 in the receiving means 38. Preferably, the plunger 64 includes a tapered head 70 so that the cap into which it extends actually retracts away from the retaining station 50 a small distance to assure that interference with insertion of the endmost cap is avoided. In the preferred embodiment, the tapered head 70 is conical to conform with a concave depression 71 in the cap 12. Engagement of the conical head 70 in the concave depression prepositions the cap 12 in proper alignment before it enters the retaining station 50 for insertion in the receiving means 38.

Figure 5:
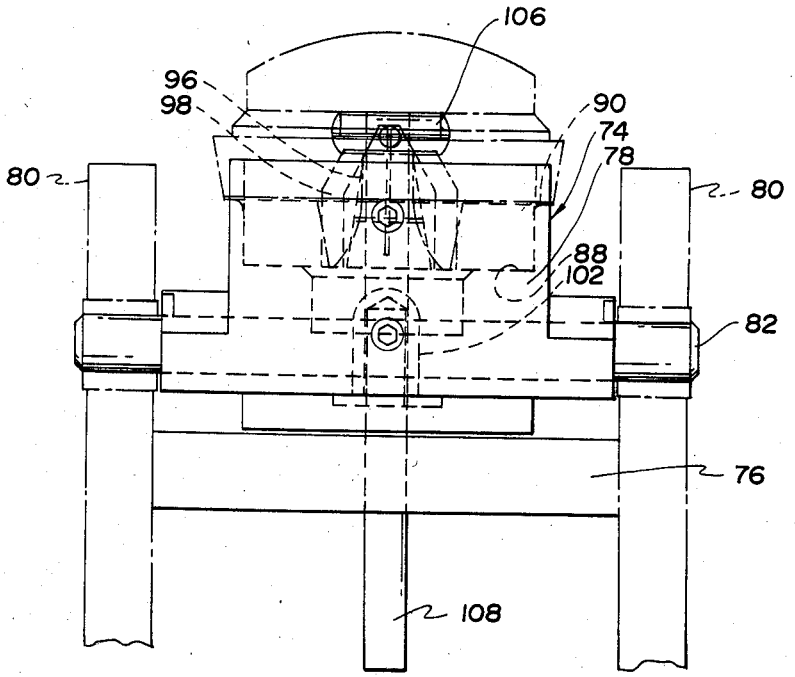
FIG. 5 is an end view of the carriage portion shown in FIGS. 3 and 4.

Referring now to FIGS. 3–5, each receiving means 38 comprises a head 74 having a base 76 and a socket body 78. The base 78 is rigidly secured between the side plates 80 of the carriage 16. The socket body 78 is supported in a substantially fixed position with respect to the base 76 by pivot pin 82 extending through a bore in the socket body and registering apertures in the side plates 80. The side plates 80 include bushings 84 mounted in the registering apertures so that the socket body 78 can pivot about the axis of the mounting pin 82. In addition, as is best shown in FIG. 4, a spring 86 resiliently urges the socket body 78 to a fixed position with respect to the base 76, and provides a floating support for the socket body. As a result, slight deviations in the height of the container or the neck size can be accommodated by the head 74 without causing distortion or destruction of the cap 12, the neck 22 or the socket body 78.

The socket body 78 defines a socket 88 adapted to receive the pour spout portion of the cap 12, and includes a peripheral ledge 90 upon which the rim 20 of the cap 12 can be seated. A guide block 92 is mounted within the socket by a mounting bolt 94. The guide block 92 includes face surfaces 98 and a projection extending outwardly from the face having lateral guide surfaces 96. The face and lateral guide surfaces abut against the peripheral edges of the slotted opening in the pour spout of the cap 12. The guide block is split, each half being joined by a threaded adjustment screw so that the width between the lateral surface portions is adjustable. The guide surfaces on the guide block 92 fixedly retain the cap in a fixed orientation within the socket 88.

In addition, a plunger 102 extending upwardly through an aperture in the bottom of the cap socket 88 is resiliently biased upwardly into the socket 88 by a spring 104 entrained within a spring socket in the base 76. While the plunger 102 is easily depressed when the cap 12 is pushed into or pulled from the socket 88, the rounded end of the plunger 102 abuts against the interior of the spout wall so that the cap cannot inadvertantly slip out of the socket during rotation of the carriage 16. In particular, the plunger 102 prevents lateral displacement along the inclined face surfaces 98.

Direct outward displacement of the cap 12 from the socket 88 is prevented by the lip 106 of a lever 108. The lever 108 is pivotally secured by a pivot pin 110 within a slot in the socket body 78. A spring 112 resiliently urges the lever toward the position shown in solid line in FIG. 4 and is retained within a spring socket in the base 76. Thus, the lever 108 is normally retained in a position where the rounded lip 106 is positioned at the edge of the rim 20 of the cap 12. However, the lip includes a cutout 114 which enables a portion of the lip 106 to slide past the edge of the rim for a purpose to be described in greater detail hereinafter.

Figure 6:
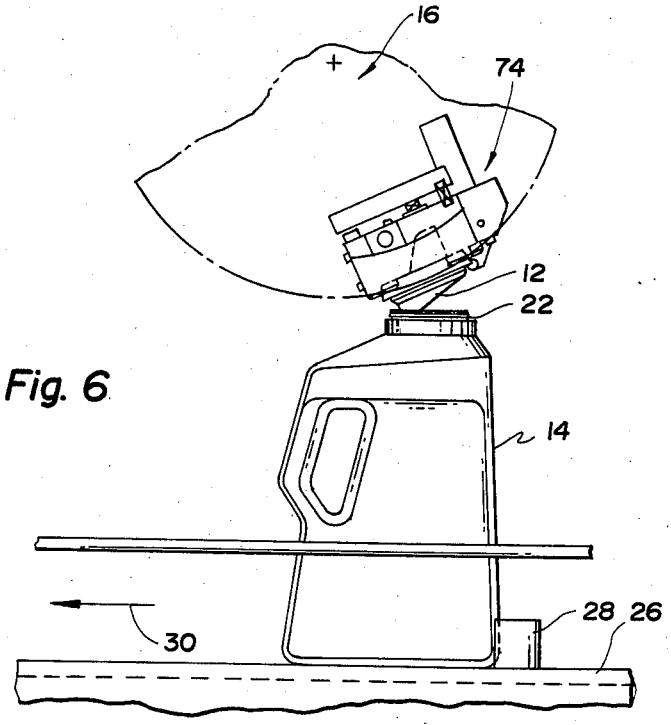
FIG. 6 is an enlarged side plan view of a portion of the apparatus shown in FIGS. 1 and 2 showing a first relative position between a cap and a container in the apparatus.

Referring now to FIG. 6, it can be seen that as the head 74 approaches the proximate carriage position closest to the conveyor track 26, the cap is aligned so that the inclined base of the cap 12 fits within the open neck 22, and a leading edge of the rim 20 is positioned for engagement with a leading portion of the neck 22. As the leading edge of the cap reaches the proximate carriage position, the leading edge of the rim 20 becomes fully engaged with the neck 22. As the head 74 moves toward the proximate carriage position shown in FIG. 7, the cap 12 is progressively forced into engagement with the neck 22 of the container 14. At the same time, while the curved surface of the lip 106 permits the container neck to slip into the trailing portion of the cap 12, the spring tension on the lever 108 from the spring 112 causes a slight deflection of the neck which minimizes the force necessary to fully engage the cap on the neck in its fully seated and interlocked position.

Figure 7:
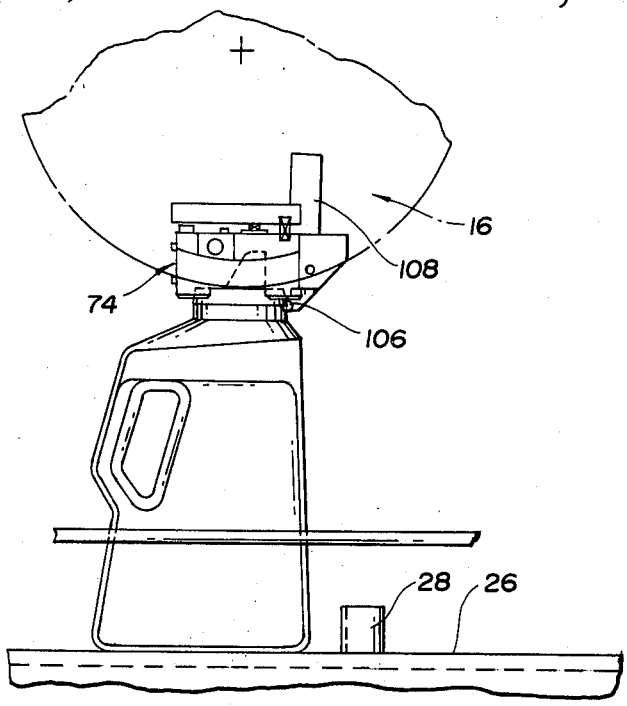
FIG. 7 is a view similar to FIG. 6 but showing the cap and the container in a second relative position in the apparatus.

At the first predetermined position at which the leading edge of the cap 12 engages the neck 22, the velocity component of the cap 12 in the direction of conveyance 30 approaches and exceeds the speed at which the projection 28 moves the container 14 in the direction of conveyance 30. Thus, as shown in FIG. 7, the container 70 slides along the track 26 of the first conveyor and becomes displaced from the projection 28. As a result, the speed of the container 14 is controlled wholly by the carriage 16 at the work station position to assure proper alignment between the cap 12 and the container neck 22. Thus, it will be understood that the projections 28 are utilized to synchronize the arrival of the container 14 at the work station simultaneously with the arrival of the head 74 at the work station, but the speed of the container during engagement of the cap 12 on the container 14 is controlled wholly by the velocity of the carriage 16 at the work station position.

Figure 8:
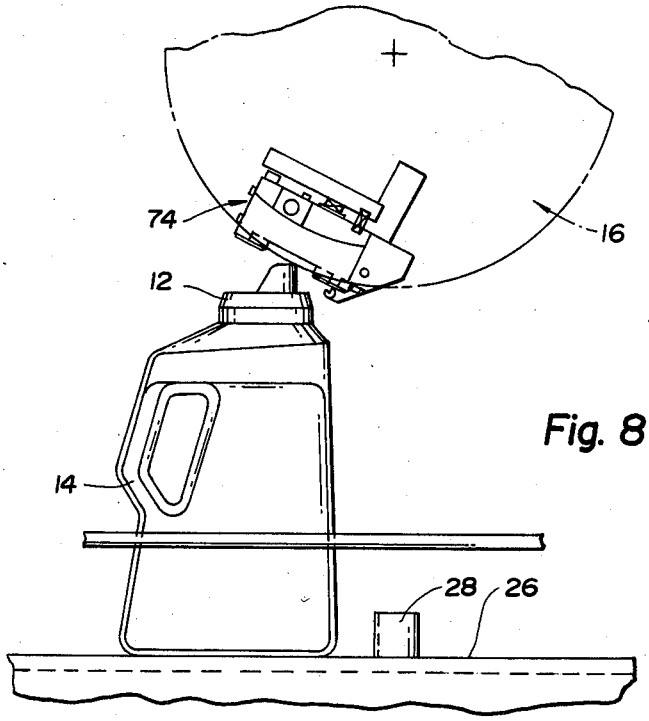
FIG. 8 is a view similar to FIGS. 6 and 7 but showing the cap and the container in a third relative position in the apparatus.

As shown in FIG. 8, once the cap 12 is tightly engaged on the neck of the container 14, displacement of the head 74 upwardly from the cap permits the cap to be retracted from the socket 88 as the container continues along the conveyor track 26 at the speed of the conveyor track 26. Moreover, while the change in tangential position of the cap with respect to the neck 22 as the cap approaches the proximate carriage position permits progressive engagement of the cap upon the neck from the first predetermined position along the direction of conveyance 30, the tangential alignment of the head 74 permits release of the cap from the head 74 downstream of the proximate carriage position. Moreover, the present invention eliminates the risk of damaging the caps or containers which can occur when snap-lock caps are not properly aligned with the neck when forceably applied to the container neck.

Thus, it will be understood that the present invention provides a capping apparatus which is well adapted for applying particularly configured pour caps adapted to lockingly engage a container neck. Moreover, the apparatus can install a wide variety of caps in a manner which avoids damage to the cap, the neck of the container, and the installing apparatus. Nevertheless, the apparatus provides a tight sealing engagement between the cap and the container. Moreover, the capping apparatus of the present invention prevents misalignment of the cap with respect to the container which can occur in other known automated capping apparatus.

Having thus described the present invention, many modifications thereto will become apparent to those skilled in the art to which it pertains without departing from the scope and spirit of the present invention as defined in the appending claims. For example, the main conveyor need not be a linear conveyor but can be a curved conveyor or even a rotating carriage similar to the carriage 16 so that the velocity of the container carriage in the direction of conveyance 30 matches the velocity of the cap carriage in that direction through the work station position.

What is claimed is:

1. An apparatus for installing caps on containers having an open neck, the opening in the neck having a central axis, comprising:

a first conveyor for sequentially, individually delivering a plurality of containers to and through a predetermined work station position along a direction of conveyance;

a means for individually positioning a cap in registration with a container neck at said predetermined work station position and for depressing the cap against the open neck of the container;

wherein said positioning and depressing means includes a carriage having an axis of rotation and having means for receiving at least one of said caps at a circumferential position of said carriage;

means for rotatably supporting said carriage in a fixed position at said work station position so that its axis of rotation is aligned perpendicular to said direction of conveyance and perpendicular to the central axis of the opening in the neck, and wherein the axis of rotation is spaced along said central axis so that a proximate carriage position closest to said conveyor positions a cap received in said receiving means for seating engagement with the container neck; and means for rotating said carriage about its axis so that the tangential velocity of the proximate carriage position closest to said first conveyor is in the same direction as said direction of conveyance;

wherein said carriage includes means for deflecting at least a portion of said neck as said receiving means approaches said proximate carriage position.

2. The invention as defined in claim 1 and further comprising means for resiliently urging said receiving means radially outwardly from the axis of said carriage, and thereby providing a floating support for said receiving means.

3. The invention as defined in claim 1 wherein said deflecting means comprises an abutment lever positioned adjacent a trailing edge portion of said receiving means.

4. The invention as defined in claim 3 and further comprising means for resiliently biasing a radially outermost end of said lever forwardly toward said receiving means.

5. The invention as defined in claim 1 and further comprising a second conveyor for individually delivering a plurality of caps to said positioning means in a fixed orientation.

6. The invention as defined in claim 5 and further comprising means for individually feeding said caps from said second conveyor into said at least one receiving means.

7. The invention as defined in claim 6 and further comprising a receiving station adjacent an end of said second conveyor.

8. The invention as defined in claim 7 wherein said feeding means comprises prepositioning means for aligning said cap in a fixed orientation upstream of said receiving station; and wherein said prepositioning means comprises retainer means for momentarily restricting displacement of a penultimate cap along said second conveyor after the endmost cap has been displaced into said receiving station.

9. The invention as defined in claim 6 wherein said feeding means comprises prepositioning means for aligning said cap in a fixed orientation.

10. The invention as defined in claim 1 and further comprising:

synchronizing means for timing the arrival of said at least one receiving means at a first predetermined position along said direction of conveyance upstream of said proximate carriage position simultaneously with the arrival of a container at said first predetermined position.

11. The invention as defined in claim 10 wherein the tangential alignment of said receiving means at said first predetermined position seats one edge of a cap contained in said at least one receiving means upon the neck of a container at said first predetermined position as said receiving means approaches said proximate carriage position.

12. The invention as defined in claim 11 wherein said means for rotating comprises:

means for rotating said carriage at an angular velocity whose linear component in the direction of conveyance exceeds the linear speed of said first conveyor in said direction of conveyance from said first predetermined position to said proximate carriage position, and further comprising means for slideably supporting said containers on said first conveyor means, whereby the speed of said container at said work station position is controlled wholly by said carriage at said work station position.

13. The invention as defined in claim 10 wherein said means for rotating comprises:

means for rotating said carriage at an angular velocity whose component in the direction of conveyance exceeds the speed of said first conveyor in the direction of conveyance from said first predetermined position to said proximate carriage position.

14. The invention as defined in claim 1 wherein said receiving means includes means for supporting and maintaining alignment of a cap in a fixed orientation with respect to said carriage.

15. The invention as defined in claim 1 wherein said receiving means includes means for retaining a cap in a fixed orientation with respect to said carriage.

16. An apparatus for installing caps on containers having an open neck, the opening in the neck having a central axis, comprising:

a first conveyor for sequentially, individually delivering a plurality of containers to and through a predetermined work station position along a direction of conveyance;

a means for individually positioning a cap in registration with a container neck at said predetermined work station position and for depressing the cap against the open neck of the container;

wherein said positioning and depressing means includes a carriage having an axis of rotation and having means for receiving at least one of said caps at a circumferential position of said carriage;

means for rotatably supporting said carriage in a fixed position at said work station position so that its axis of rotation is aligned perpendicular to said direction of conveyance and perpendicular to the central axis of the opening in the neck, and wherein the axis of rotation is spaced along said central axis so that a proximate carriage position closest to said conveyor positions a cap received in said receiving means for seating engagement with the container neck;

means for rotating said carriage about its axis so that the tangential velocity of the proximate carriage position closest to said first conveyor is in the same direction as said direction of conveyance;

a second conveyor for individually delivering a plurality of caps to said positioning means in a fixed orientation;

means for individually feeding said caps from said second conveyor into said at least one receiving means;

a receiving station adjacent an end of said second conveyor;

wherein said feeding means comprises prepositioning means for rotationally aligning said cap in a fixed orientation upstream of said receiving station; and wherein said prepositioning means comprises retainer means for momentarily restricting displacement of a penultimate cap along said second conveyor after the endmost cap has been displaced into said receiving station.

17. The invention as defined in claim 16 wherein said prepositioning means comprises a conical punch.

18. An apparatus for installing caps on containers having an open neck, the opening in the neck having a central axis, comprising:

a first conveyor for sequentially, individually delivering a plurality of containers to and through a predetermined work station position along a direction of conveyance;

a means for individually positioning a cap in registration with a container neck at said predetermined work station position and for depressing the cap against the open neck of the container;

wherein said positioning and depressing means includes a carriage having an axis of rotation and having means for receiving at least one of said caps at a circumferential position of said carriage;

means for rotatably supporting said carriage in a fixed position at said work station position so that its axis of rotation is aligned perpendicular to said direction of conveyance and perpendicular to the central axis of the opening in the neck, and wherein the axis of rotation is spaced along said central axis so that a proximate carriage position closest to said conveyor positions a cap received in said receiving means for seating engagement with the container neck;

means for rotating said carriage about its axis so that the tangential velocity of the proximate carriage position closest to said first conveyor is in the same direction as said direction of conveyance;

synchronizing means for timing the arrival of said at least one receiving means at a first predetermined position along said direction of conveyance upstream of said proximate carriage position simultaneously with the arrival of a container at said first predetermined position;

wherein the tangential alignment of said receiving means at said first predetermined position seats one edge of a cap contained in said at least one receiving means upon the neck of a container at said first predetermined position as said receiving means approaches said proximate carriage position; and means for rotating said carriage at an angular velocity whose linear component in the direction of conveyance exceeds the linear speed of said first conveyor in said direction of conveyance from said first predetermined position to said proximate carriage position, and further comprising means for slideably supporting said containers on said first conveyor, whereby the speed of said contaienr at said work station position is controlled wholly by said carriage at said work station position.

19. An apparatus for installing caps on containers having an open neck, the opening in the neck having a central axis, comprising:

a first conveyor for sequentially, individually delivering a plurality of containers to and through a predetermined work station position along a direction of conveyance;

a means for individually positioning a cap in registration with a container neck at said predetermined work station position and for depressing the cap against the open neck of the container;

wherein said positioning and depressing means includes a carriage having an axis of rotation and having means for receiving at least one of said caps at a circumferential position of said carriage;

means for rotatably supporting said carriage in a fixed position at said work station position so that its axis of rotation is aligned perpendicular to said direction of conveyance and perpendicular to the central axis of the opening in the neck, and wherein the axis of rotation is spaced along said central axis so that a proximate carriage position closest to said conveyor positions a cap received in said receiving means for seating engagement with the container neck;

means for rotating said carriage about its axis so that the tangential velocity of the proximate carriage position closest to said first conveyor is in the same direction as said direction of conveyance;

means for resiliently urging said receiving means radially outwardly from the axis of said carriage, and thereby providing a floating support for said receiving means; and wherein said carriage includes means for deflecting at least a portion of said neck as said receiving means approaches said proximate carriage position.

20. An apparatus for installing caps on containers having an open neck, the opening in the neck having a central axis, comprising:

a first conveyor for sequentially, individually delivering a plurality of containers to and through a predetermined work station position along a direction of conveyance;

a means for individually positioning a cap in registration with a container neck at said predetermined work station position and for depressing the cap against the open neck of the container;

wherein said positioning and depressing means includes a carriage having an axis of rotation and having means for receiving at least one of said caps at a circumferential position of said carriage;

means for rotatably supporting said carriage in a fixed position at said work station position so that its axis of rotation is aligned perpendicular to said direction of conveyance and perpendicular to the central axis of the opening in the neck, and wherein the axis of rotation is spaced along said central axis so that a proximate carriage position closest to said conveyor positions a cap received in said receiving means for seating engagement with the container neck;

means for rotating said carriage about its axis so that the tangential velocity of the proximate carriage position closest to said first conveyor is in the same direction as said direction of conveyance;

synchronizing means for timing the arrival of said at least one receiving means at a first predetermined position along said direction of conveyance upstream of said proximate carriage position simultaneously with the arrival of a container at said first predetermined position; and means for rotating said carriage at an angular velocity whose component in the direction of conveyance exceeds the speed of said first conveyor in the direction of conveyance from said first predetermined position to said proximate carriage position.

* * * * *

UNITED STATES PATENT AND TRADEMARK OFFICE

CERTIFICATE OF CORRECTION

PATENT NO. : 4,696,143

DATED : September 29, 1987

INVENTOR(S) : William P. Young

It is certified that error appears in the above-identified patent and that said Letters Patent is hereby corrected as shown below:

| | |
|---|---|
| Column 1, Line 8, | "automaticaly" should be --automatically--; |
| Column 10, Claim 18, Line 49, | "contaienr" should be --container--. |

Signed and Sealed this

Sixteenth Day of February, 1988

*Attest:*

*Attesting Officer*

DONALD J. QUIGG

*Commissioner of Patents and Trademarks*